US010715921B2

(12) United States Patent
Dodd et al.

(10) Patent No.: US 10,715,921 B2
(45) Date of Patent: Jul. 14, 2020

(54) LOUDSPEAKER

(71) Applicant: GP Acoustics International Limited, Maidstone (GB)

(72) Inventors: Mark Alexander Dodd, Woodridge (GB); Jack Anthony Oclee-Brown, Staplehurst (GB); Christopher Spear, Maidstone (GB)

(73) Assignee: GP ACOUSTICS INTERNATIONAL LIMITED, Maidstone (GB)

( * ) Notice: Subject to any disclaimer, the term of this patent is extended or adjusted under 35 U.S.C. 154(b) by 0 days.

(21) Appl. No.: 16/165,356

(22) Filed: Oct. 19, 2018

(65) Prior Publication Data

US 2019/0124450 A1 Apr. 25, 2019

(30) Foreign Application Priority Data

Oct. 20, 2017 (GB) ..... 1717240.4

(51) Int. Cl.
*H04R 9/06* (2006.01)
*H04R 1/28* (2006.01)
(Continued)

(52) U.S. Cl.
CPC ..... *H04R 9/063* (2013.01); *H04R 1/025* (2013.01); *H04R 1/24* (2013.01); *H04R 1/2826* (2013.01);
(Continued)

(58) Field of Classification Search
CPC ..... H04R 1/24; H04R 1/2826; H04R 1/2857; H04R 1/403; H04R 9/025; H04R 9/06; H04R 9/063; H04R 2400/13
(Continued)

(56) References Cited

U.S. PATENT DOCUMENTS 2,269,284 A * 1/1942 Olson ..... H04R 1/24 381/342
4,769,848 A 9/1988 Eberbach
(Continued)

FOREIGN PATENT DOCUMENTS

JP S5553383 U 4/1980
JP S55142084 U 10/1980

OTHER PUBLICATIONS

Search Report issued for GB application No. 1717240.4, dated Apr. 13, 2018.

*Primary Examiner* — Huyen D Le
(74) *Attorney, Agent, or Firm* — Westerman, Champlin & Koehler, P.A.; Z. Peter Sawicki; Amanda M. Prose

(57) ABSTRACT

Sound emanating from the high-frequency diaphragm of a coaxial speaker will diffract into the annular gap between the tweeter unit and the midrange cone. This results in response irregularities. We therefore disclose a loudspeaker, comprising first and second drivers located substantially coaxially with the first driver located centrally and the second driver located concentrically around the first driver, the loudspeaker being bounded at its radially outer side for at least part of its extent by the voice coil former of the second driver and including a spacing between the outermost extent of the first driver and the innermost extent of the second driver thus defining an annular space, the annular space containing a sound-absorbent material. By placing the sound-absorbing material in the annular space, the resonances within this space are damped, thus alleviating their effect. The annular space can have a lower resonant frequency that is below the passband of the first driver. Essentially, instead of minimising the effect of the annular gap by reducing its size and seeking to seal its outer opening, we propose to enlarge the space so that the fundamental resonant frequency it exhibits drops out of the passband of the high-frequency driver and
(Continued)

hence out of the frequency range of interest. This both prevents the fundamental frequency of the cavity from being excited, and also allows sufficient room within the space to accommodate a sound-absorbent material to absorb these undesirable resonances.

17 Claims, 7 Drawing Sheets

(51) Int. Cl.
*H04R 1/24* (2006.01)
*H04R 1/02* (2006.01)
*H04R 7/04* (2006.01)
*H04R 9/02* (2006.01)

(52) U.S. Cl.
CPC ..... *H04R 7/04* (2013.01); *H04R 9/025* (2013.01); *H04R 9/06* (2013.01); *H04R 1/2857* (2013.01); *H04R 2400/13* (2013.01)

(58) Field of Classification Search
USPC ..... 381/353, 354, 182, 186, 401, 402, 403, 381/424
See application file for complete search history.

(56) References Cited

U.S. PATENT DOCUMENTS

| | | | | |
|---|---|---|---|---|
| 5,373,565 | A * | 12/1994 | Watanabe | H04R 1/24 381/182 |
| 5,548,657 | A | 8/1996 | Fincham | |
| 6,095,280 | A * | 8/2000 | Proni | H04R 7/20 181/171 |
| 2013/0142379 | A1 | 6/2013 | Varla et al. | |

* cited by examiner

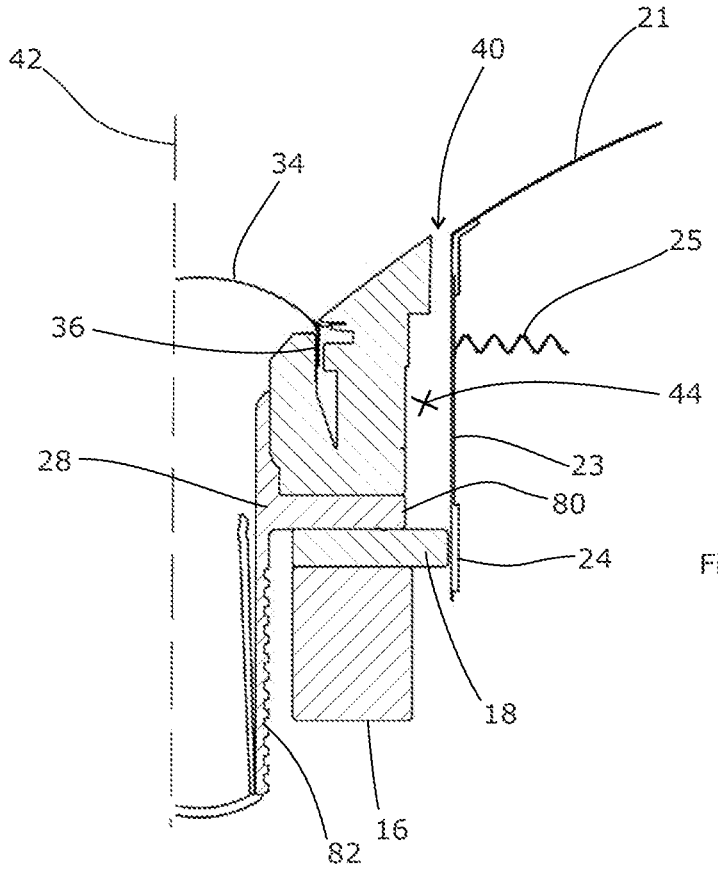
Fig 2
Fig 3
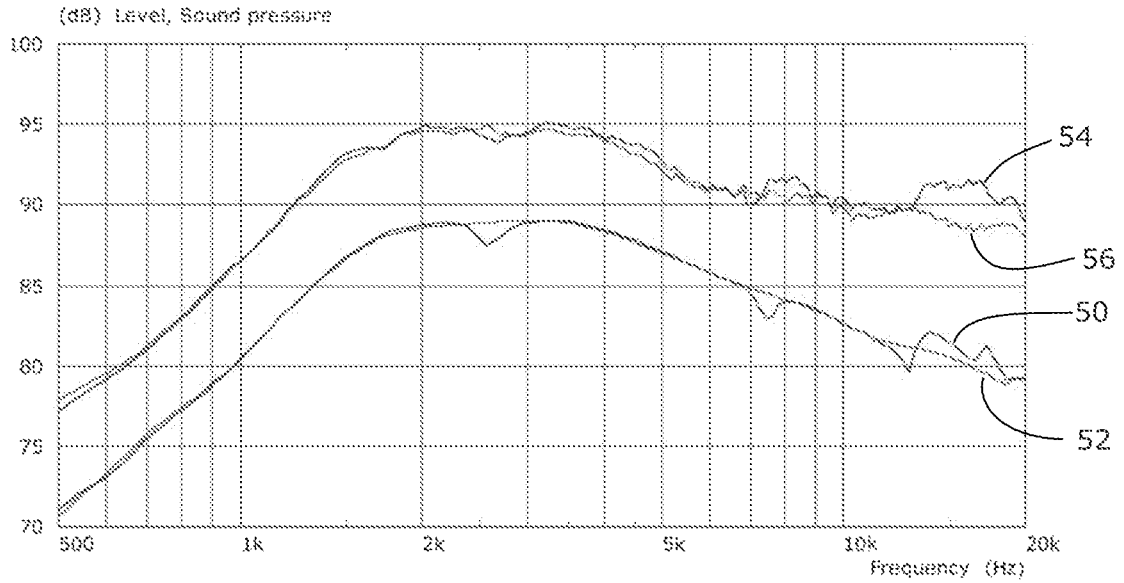

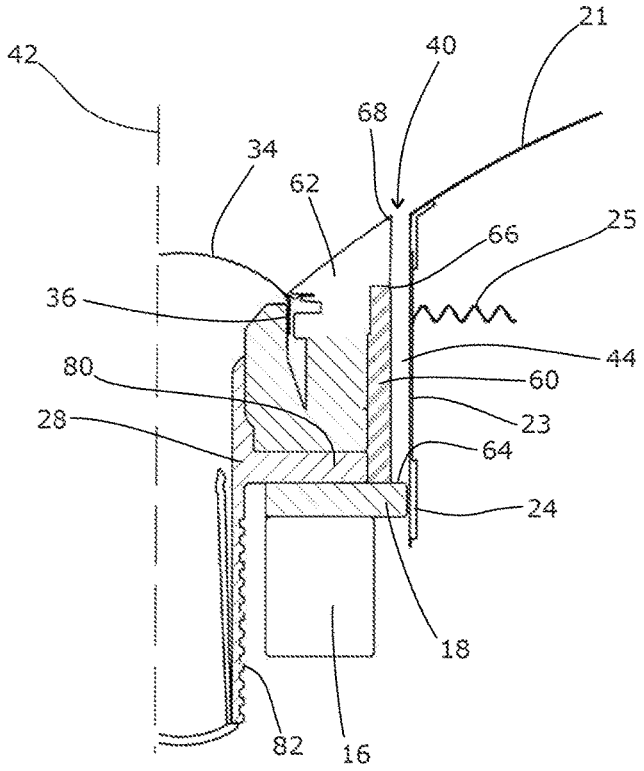
Fig 4
Fig 5
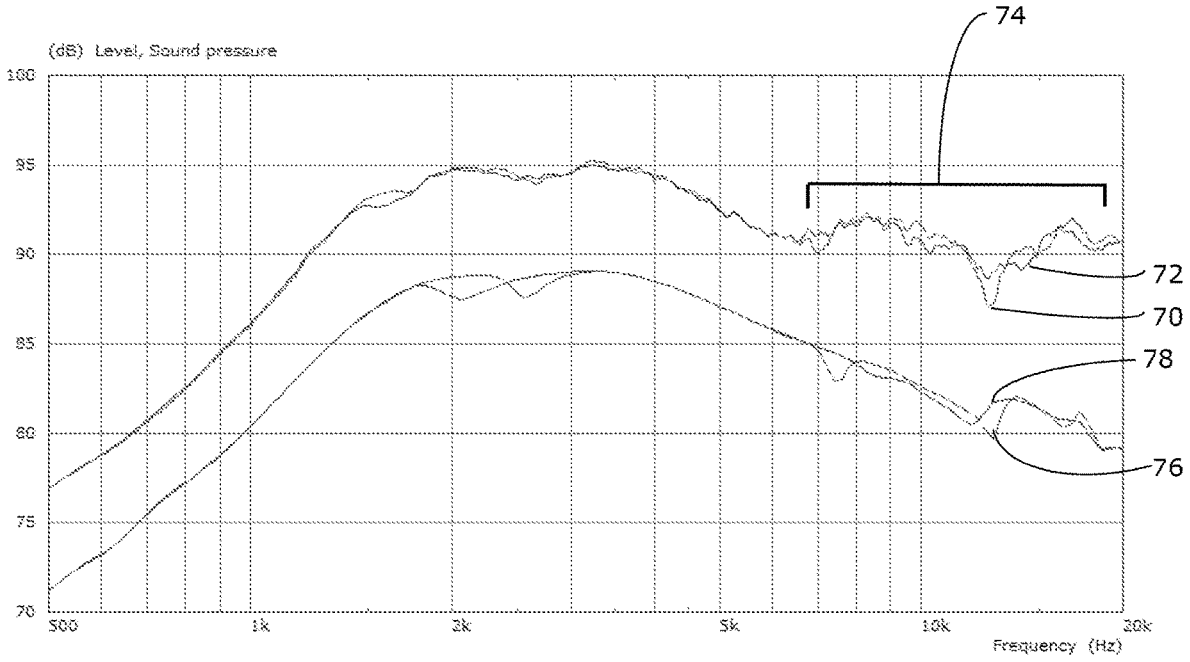

LOUDSPEAKER

FIELD OF THE INVENTION

The present invention relates to co-axial loudspeakers.

BACKGROUND ART

Co-axial loudspeakers are designed with a high frequency drive unit positioned at or adjacent to the neck of the diaphragm of a low frequency drive unit, as shown in U.S. Pat. No. 5,548,657 and FIG. 1 of the accompanying drawings. As a result, the apparent sound source or acoustic centre of the high frequency drive unit is substantially co-incident with the apparent sound source or acoustic centre of the low frequency drive unit. With the high frequency drive unit positioned adjacent to the neck of the low frequency diaphragm, the form of the low frequency diaphragm imposes its directivity (if any) upon the radiation pattern or directivity of the high frequency unit. Consequently at frequencies at which both drive units contribute significant sound output, both drive units have substantially similar patterns of radiation or directivity. As a result the relative sound contributions from the two drive units, as perceived by a listener, are substantially unaffected by the listener being positioned at off axis positions. Such arrangements have become well known since U.S. Pat. No. 5,548,657 in the form of our UNI-Q™ speaker.

Referring to FIG. 1, the compound loudspeaker drive unit with low frequency and high frequency transducers having co-axial low and high frequency voice coils comprises a chassis 10 in the form of a conical basket having a front annular rim 11 connected to a rear annular member 12 by means of a number of ribs 13. The rear annular member 12 has an annular flange 14 and an annular seat 15. Secured to the flange 14 is a first magnetic structure 16 for the low frequency loudspeaker drive unit. The magnetic structure 16 comprises a magnet ring 17, a front annular plate 18 which forms an outer pole and a member which forms a backplate 19 and an inner pole 20. The plate 18, magnet ring 17 and member are held together to provide a magnetic path interrupted by a non-magnetic air gap between the outer pole 18 and the inner pole 20. The poles are circular and form therebetween an annular air gap. The low frequency transducer or loudspeaker drive unit comprises a diaphragm 21 of generally frusto-conical form supported along the front outer edge thereof by a flexible surround 22 secured to the front rim 11 of the chassis 10. A tubular coil former 23 is secured to the rear edge of the diaphragm 21 and is arranged to extend co-axially of the air gap in the magnetic structure 16. The coil former carries a voice coil 24 positioned on the former such that the coil extends through the air gap. The coil is of sufficient axial length as to ensure that for normal excursions of the voice coil, the poles always lie within the length of the voice coil. A suspension member 25 is secured between the coil former 23 and the annular seat 15 of the chassis 10 in order to ensure that the coil former, and voice coil carried thereby, are maintained concentric with the poles of the magnetic structure and out of physical contact with the poles during sound producing excursions of the diaphragm 21. The member forming the backplate 19 and inner pole has a bore 26 extending co-axially thereof for the purpose of mounting a high frequency drive unit 27.

The high frequency transducer or drive unit 27 comprises a second magnetic structure consisting of a pot 28, a disc shaped magnet 29 and a disc shaped inner pole 30. The pot 28 has a cylindrical outer surface so dimensioned as to fit within the interior of the coil former 23 without making physical contact therewith. The pot is formed with a circular recess 31 to receive the magnet 29 and an annular lip 32 to form an outer pole. One circular pole face of the magnet 29 is held in engagement with the bottom wall of the recess 31 and the disc shaped inner pole 30 is held in engagement with the other circular pole face of the magnet such that the circular outer periphery of the inner pole 30 lies co-axially with and within the lip 32 forming the outer pole. An air gap extends between the inner and outer poles. A spacer ring 33 is secured to the front face of the pot 28. A high frequency domed diaphragm 34 has an annular support 35 secured at its outer periphery to the spacer ring 33. Secured to the domed diaphragm 34 is a cylindrical coil former carrying a high frequency voice coil 36 such that the voice coil extends through the air gap between the poles 30, 32 of the magnetic structure.

As a result of the coaxial design, such loudspeakers have an annular gap 40 extending axially between the high frequency unit 27 and the midrange voice coil former 23. This gap is necessary to provide clearance so the midrange voice coil can move freely without touching the tweeter body. However, it defines a generally cylindrical channel 44 around the high-frequency unit 27 which allows some unwanted acoustic resonances to take place, causing irregularities in the high frequency response.

Existing coaxial drivers are mostly designed to minimize this volume of air and keep the width of the gap between the tweeter and the midrange cone as small as possible. Cylindrical inserts have been placed in the gap, to reduce its overall volume. A different approach that has been adopted is to separate the air channel with a flexible seal, such as in US 2013/0142379 which describes a small flexible surround covering the air gap between the tweeter and the midrange drivers. This approach prevents the resonances inside the air channel from affecting the high frequency response of the unit, but in order to present a smooth waveguide for the tweeter this additional surround must be conical or very small. As a result, its stiffness varies strongly with displacement thereby causing harmonic distortion and limiting the maximum sound pressure level of the midrange driver. Other designers have incorporated a large half roll rubber surround between the high frequency unit and midrange cone; this introduces a large physical discontinuity to the waveguide instead, and will introduce significant diffraction to the high frequency response of the unit.

SUMMARY OF THE INVENTION

FIG. 2 shows a simplified and updated coaxial design which illustrates this point further. Like reference numerals are used in FIG. 2 to denote equivalent parts to those of FIG. 1. This design is rotationally symmetric around the axis 42, and therefore only one half is shown. Non-rotationally symmetric designs such as elliptical, race-track and other voice coil/gap geometries are also possible (although harder to manufacture) but operate according to similar principles. We will describe rotationally symmetric geometries in this application, but the invention is equally applicable to other designs and terms such as "annular", "concentric" and the like should be interpreted accordingly.

Sound emanating from the high-frequency diaphragm 34 will be projected forwardly and outwardly within the confines of the mid-range diaphragm 21; some will diffract down the annular gap 40 between the tweeter and midrange cone and into the annular channel 44 behind. Sound entering this channel excites cavity resonances causing response irregularities. FIG. 3 shows a graph of FEA simulations of a high frequency drive unit inside a midrange loudspeaker 50 and inside a smooth horn 52, each of the same geometry. Also shown in FIG. 3 are the corresponding actual 2 pi measurements of a high frequency drive unit within a midrange loudspeaker 54, and inside a smooth aluminium horn 56, again with each having the same geometry. The effects of the 1st and 3rd harmonic of the quarter wave resonance inside the air channel can be clearly observed in both the simulation and measurement, acting akin to a closed-open pipe—in this case 35 mm long including an end correction. On this graph the simulation results have been offset by −6 dB for ease of visibility. The analogy with a pipe is useful for the purpose of understanding the concept, but not a precise equivalent. A rigorous design process should use finite-element-analysis (FBA) techniques, to take into account the differences from a simple pipe which may perturb the resonant frequencies of the cavity, such as area variations along the channel.

The present invention therefore provides a loudspeaker, comprising first and second drivers located substantially coaxially with the first driver located centrally and the second driver located around the first driver, the loudspeaker including a spacing between the outermost extent of the first driver and the innermost extent of the second driver thus defining an axially-extending space, the space being bounded at its radially outer side for at least part of its axial extent by the voice coil former of the second driver and containing a sound-absorbent material. By placing the sound-absorbing material in the annular space, the resonances within this space are damped, thus alleviating their effect.

It is preferred that the space has a quarter-wave resonant frequency that is below the passband of the first driver. This has three effects; first, it will generally mean a larger space, which will create more room in which to place the sound-absorbent material. Second, the sound absorbent material can completely fill a sufficient length of the cavity to provide some damping on the primary resonance. Thirdly, it will ensure that the primary resonance of the space will be out of the first driver's working range, minimising its impact on its response.

Preferably, the sound-absorbent material is contained within the space along one edge thereof, leaving an air space remaining adjacent to the voice coil former and allowing it to move freely. This air space should be minimised, however, as it provides a path for the sound free from absorption and thus limits the impact of the absorbing material on the fundamental resonance. This edge is preferably the inner edge, so that the sound-absorbent material is kept physically clear of the voice coil of the second driver and thus does not affect its movement. Additionally or alternatively, a thin cylindrical sleeve, formed of a material which is acoustically permeable, can be inserted axially in the annular space, to separate the static sound-absorbent material from the moving voice coil and also further reduce the volume of the air space.

The space is preferably annular and concentric around the first driver. It need not be uniform along its (axial) extent; it may have a radius which varies along its extent, either smoothly or in a stepwise manner Preferably, the radius is at its maximum adjacent the diaphragms of the first and second drivers; narrowing toward the rear of the loudspeaker following the external profile of the first driver. Other arrangements are possible, however; the annular space may follow any desired shape and is in general dictated by the exterior profile of the first driver unit and the interior profile of the second driver unit, as noted below. It can in principle have any cross sectional shape, but it is better that its cross-sectional area does not change too suddenly. It need not be unitary, for example an annular channel adjacent to the voice coil could lead to two elongate rectangular channels. Generally, the driver units are not uniformly cylindrical and thus the annular space may extend longitudinally behind parts of one or more drivers such as diaphragms, surrounds and the like. The cavity may also be extended in a non-annular form where geometrical restraints allow.

The annular space can be defined by the first and second drivers themselves. In that case, it will be bounded at its radially inner side (for at least part of its axial extent) by a circumferentially-extending solid housing of the first driver. It is also bounded at its radially outer side for at least part of its axial extent by the voice coil former of the second driver, and/or by the magnet structure of the second driver. If the sound-absorbent material is provided in the space bounded by the voice coil former then we prefer that there is a physical separation of the sound-absorbent material and the voice coil, such as by a small air gap between them. It is therefore preferable for the space to extend rearwardly past the voice coil former, such as between the first driver and the magnet structure of the second driver, thus allowing the additional channel length to be completely filled with absorbent material. As a consequence of the increased length, the first mode is out of the driver's passband and is fully suppressed due to the additional channel length being completely filled.

The sound-absorbent material can be one of an acoustic foam, a fabric, an open-cell foam, and a closed-cell foam or other porous material. These (and other) sound-absorbent materials are typically soft in nature, so it is convenient to support them on a former that is fitted to the first driver. The former can comprise a cylindrical section that fits around the first driver, and preferably also circumferentially-outwardly-projecting fingers for supporting the sound-absorbent material. In that case, the sound-absorbent material can be formed in a shape that accommodates the fingers.

In a further aspect of the present invention, we provide a loudspeaker comprising first and second drivers located substantially coaxially with the first driver located within the cavity formed by the voice coil of the second driver, the loudspeaker including an axially-extending spacing between the outermost extent of the first driver and the innermost extent of the voice coil of the second driver, the spacing being bounded at its radially outer side for at least part of its axial extent by the voice coil former of the second driver and containing a sound-absorbent material.

Essentially, the present invention takes a different approach to that employed previously in this regard. To date, efforts have been made to minimise the effect of the annular gap by reducing its size and seeking to seal its outer opening. Instead, we propose to enlarge the space so that the fundamental resonant frequency it exhibits drops out of the passband of the high-frequency driver and hence out of the frequency range of interest. This both prevents the fundamental frequency of the cavity from being excited, and also allows sufficient room within the space to accommodate a sound-absorbent material which will absorb (especially) the higher resonances.

BRIEF DESCRIPTION OF THE DRAWINGS

An embodiment of the present invention will now be described by way of example, with reference to the accompanying figures in which;

FIG. 2 illustrates a co-axial speaker design with a resonant cavity;

FIG. 3 shows the frequency-sound pressure response of the speaker design of FIG. 2;

FIG. 4 shows a first embodiment of the present invention;

FIG. 5 shows the frequency-sound pressure response of the speaker design of FIG. 4 vs that of FIG. 2;

DETAILED DESCRIPTION OF THE EMBODIMENTS

Figure 1:
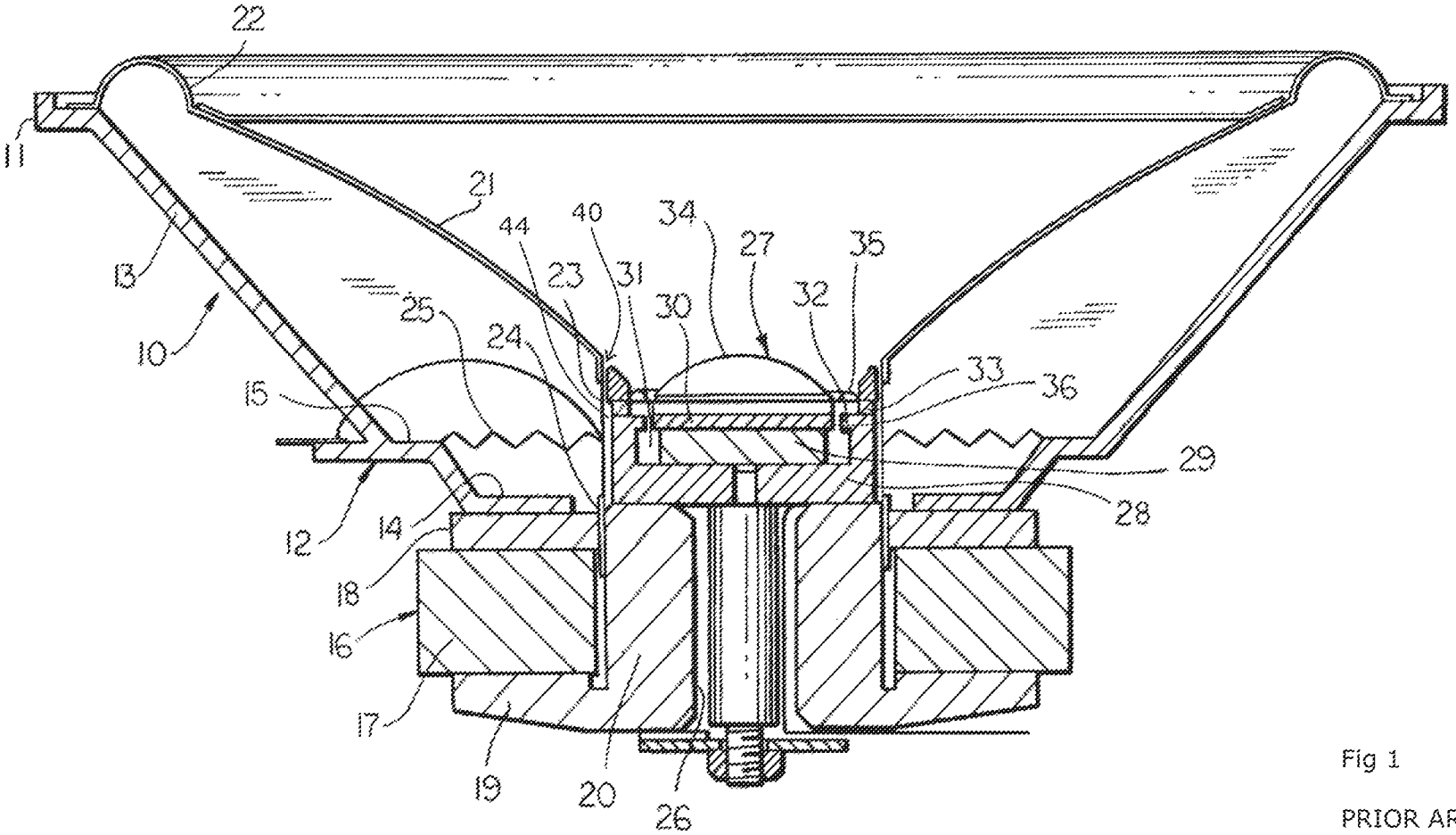
Fig 1 PRIOR ART
FIG. 1 illustrates a known arrangement of a co-axial loudspeaker.

FIG. 4 shows a first embodiment of the invention. This shares several features with the arrangement of FIG. 2, and like reference numerals are used to denote like parts. The embodiment differs from the arrangement of FIG. 2 in that an annular sleeve of sound-absorbent material 60 in the form of acoustic foam has been fitted around the tweeter unit. This sits in the space between the outer trim 62 of the tweeter unit and the voice coil former 23 of the midrange unit, and effectively lines one side of the annular channel 44 from its deepest point 64 up to a point 66 just behind a ledge 68 of the outer trim 62. The ledge 68 thus conceals the sound-absorbent material 60 from view.

Sound vibrations entering into the annular channel 44 will therefore be damped, and thus will have a reduced effect on the loudspeaker response. FIG. 5 illustrates measurements comparing the tweeter according to FIG. 2 but with a rigid card sleeve in the annular space 44 (line 70), and the tweeter of FIG. 4 with the acoustic damping sleeve 46 (line 72). The modification has successfully improved the upper part 74 of the tweeters response. Simulations of the tweeter using a rigid card (line 76) and the tweeter of FIG. 4 (line 78) bear this out; as before the simulations have been displaced by −6 dB for clarity. The odd order harmonics of the quarter wave resonance at approximately 7 kHz and 12 kHz are no longer present in the frequency response of the tweeter with the modification. The primary resonance is lowered in frequency by around 500 Hz.

Figure 6:
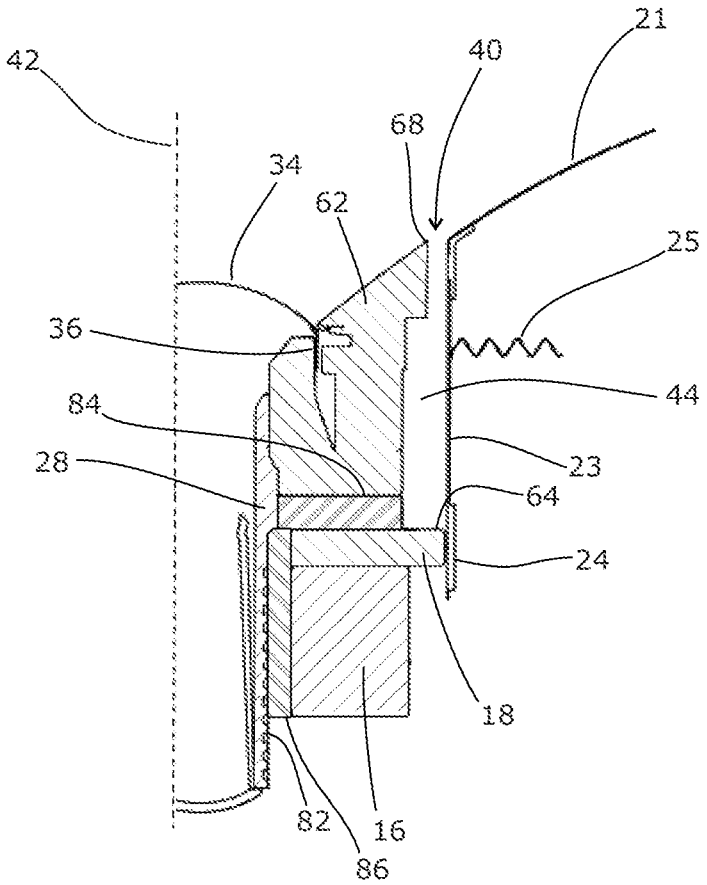
FIG. 6 shows a second embodiment of the present invention.

In this design, the thickness of the acoustic material 60 does need to be carefully chosen so that it does not come into contact with the voice coil former 23 of the midrange driver. Such contact would affect the movement of the midrange voice coil and have an adverse effect on the loudspeaker. FIG. 6 therefore shows an alternative embodiment which addresses this by extending the air path. Referring briefly back to FIGS. 2 and 4, the tweeter unit is supported in place by fitting concentrically within the magnet structure 16, 18 of the midrange unit. The pot 28 has a radially-extending flange 80 which sits on the forward surface of the front annular plate 18 and, behind that, an external screw thread 82 which allows a ring nut (not shown) to be fitted to the rear of the tweeter unit to clamp against the rear face of the magnet structure 16. In the embodiment of FIG. 6, the radially-extending flange 80 is omitted and replaced with a disc 84 of sound-absorbent material. In addition, there is an axially-extending space allowing for a sleeve 86 or sound-absorbent material to be fitted around the pot 28 behind and abutting against the disc 84. As a result, the annular space 44 is considerably extended; instead of ending at the midrange magnet structure 16, 18, it extends inwardly past the rear of the outer trim 62 of the tweeter (in the space occupied by the flange 80 shown in FIG. 4) and continues further axially in a narrower annular shape around the tweeter pot 28. The effect is to extend the air channel 44 (rather than seek to eliminate it) so that it now extends axially to the rear of the midrange magnet structure 16; this both moves its quarter-wave frequency below the output range of the tweeter and also provides space to accommodate the sound-absorbent material 84, 86 so that it is mostly away from the moving midrange voice coil 23, with only the only that part positioned at the same location as the radially outermost edge of flange 80 in FIG. 4 being in the vicinity of the voice coil 23. The sound-absorbent material 84, 86 can fill the extended part of the air channel, thus preventing sound from bypassing the foam. As mentioned above, the volume of the forward axially-extending part of the air channel 44 shown in FIG. 6 which contains no sound-absorbent material can be further reduced by inserting into it a thin axial sleeve of acoustically-permeable material such as paper, perforated card or mesh, taking care that this is not in contact with the moving voice coil 23.

Figure 7:
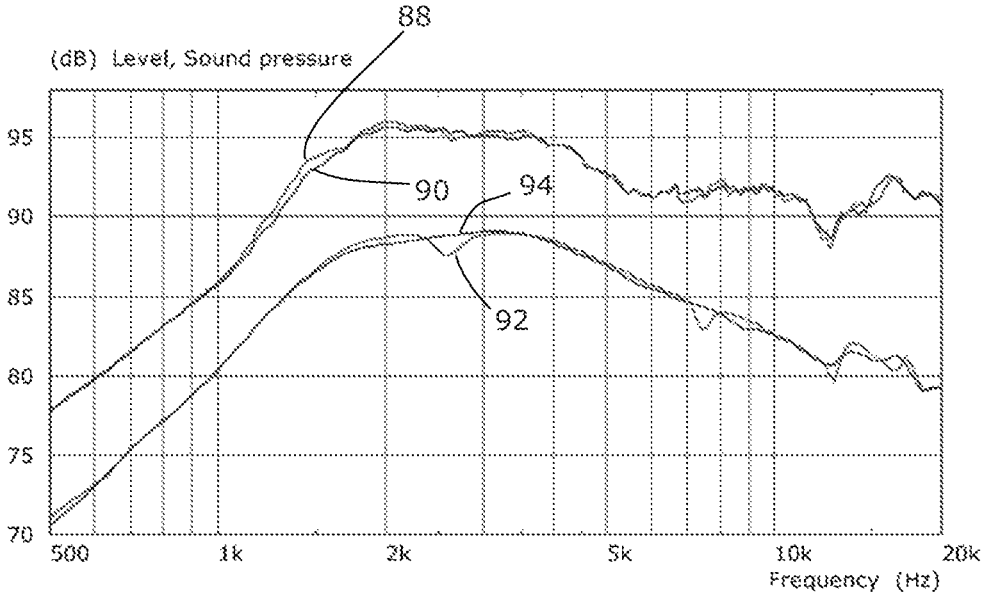
FIG. 7 shows the frequency-sound pressure response of the speaker design of FIG. 6 vs that of FIG. 2.

The total length of the air channel in FIG. 6 is now roughly twice as long as the original length in FIG. 2. As a result, the quarter wave resonance is reduced to around 1000 Hz so is no longer in the tweeter's effective passband when crossed over in a loudspeaker system. FIG. 7 shows corresponding simulations and measurements, lines 88 and 90 being the measurements comparing the FIG. 2 and FIG. 4 arrangements respectively, and lines 92 and 94 (respectively) being the corresponding simulations displaced by −6 dB. FIG. 7 shows that the acoustic absorbing material inside the elongated channel has effectively damped the quarter wave resonance and higher harmonics, avoiding response irregularities.

Figure 8:
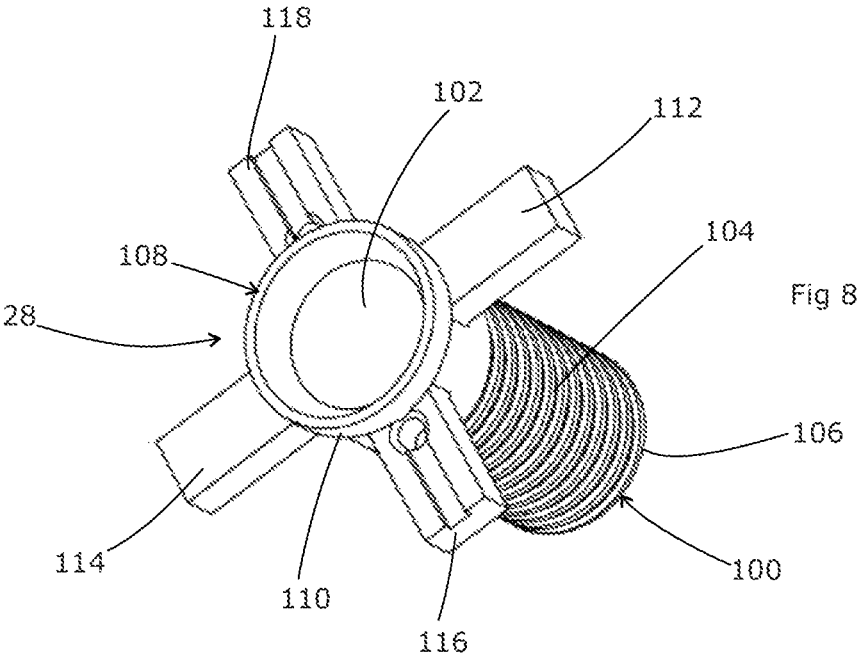
FIG. 8 shows an isometric view of a former suitable for supporting an acoustic foam element according to the present invention.
Figure 9:
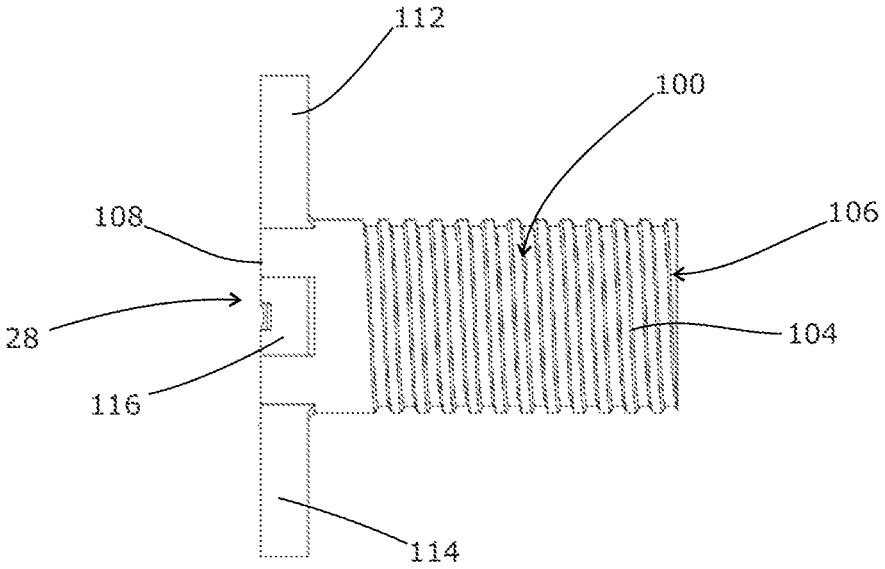
FIG. 9 shows a side view of the former of FIG. 8.

FIGS. 8 and 9 show a preferred form for the tweeter pot 28 of FIG. 4. This both contains the tweeter structure and also supports the sound-absorbing material 84, 86. It comprises a generally cylindrical part 100, with a central bore 102 within the cylindrical part 100 to contain the tweeter structure. The cylindrical part 100 is externally threaded at 104, extending from a rearmost end 106 in order to accept a ring nut to secure the tweeter in place as described above. At a frontmost end 108, the cylindrical part has a retention collar 110 (not shown on FIG. 9) to assist in retaining it in place within the loudspeaker structure.

Immediately behind the collar 110, four fingers 112, 114, 116, 118 extend radially outwardly from the cylindrical part 100, equally spaced at 90° intervals. Each finger is in the form of a rectangular tab that extends radially between ½ to ⅔ of the radial distance occupied by the disc 84 of sound-absorbent material. The tabs support the disc and allow it to be placed around the tweeter in a stable configuration for assembly of the loudspeaker. The disc 84 may have recesses or rebates formed in it to accommodate the fingers, thus reducing the distortion of the disc 84 around the fingers. Located in the gap occupied by the disc 84, the fingers also stop the ring nut from overtightening the tweeter and crushing the disc 84.

Fingers 116, 118 have elongate grooves extending radially outward from a through hole formed in the fingers 116, 118 adjacent collar 110 to allow wired connections to pass to the high frequency driver.

The sleeve 86 fits around the cylindrical part 100 behind the fingers, and can remain in place due to being a snug fit. Retention of the sleeve 86 is assisted by the screw thread 104 which will provide additional grip.

Figure 10:
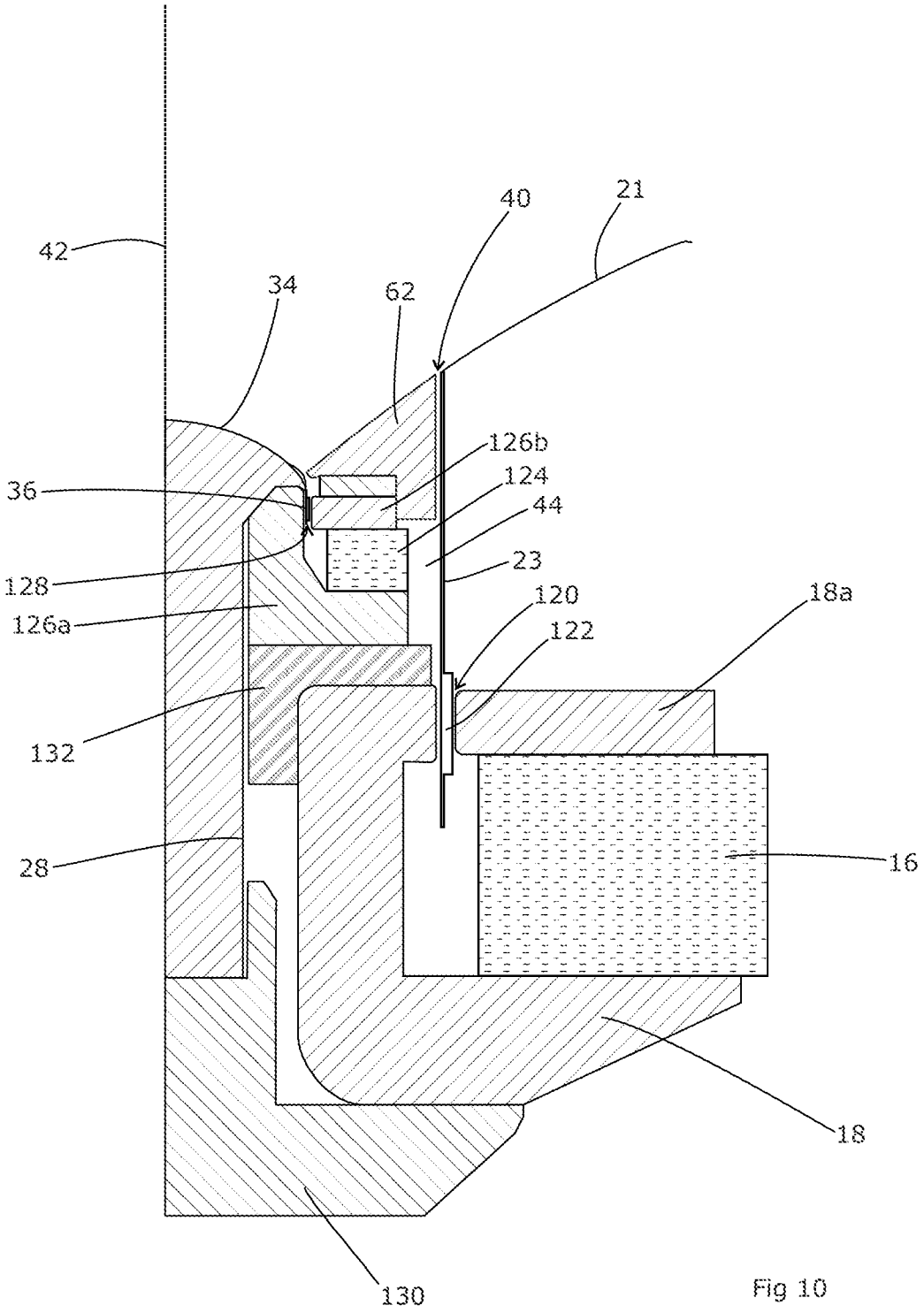
FIG. 10 shows a third embodiment of the present invention.
Figure 11:
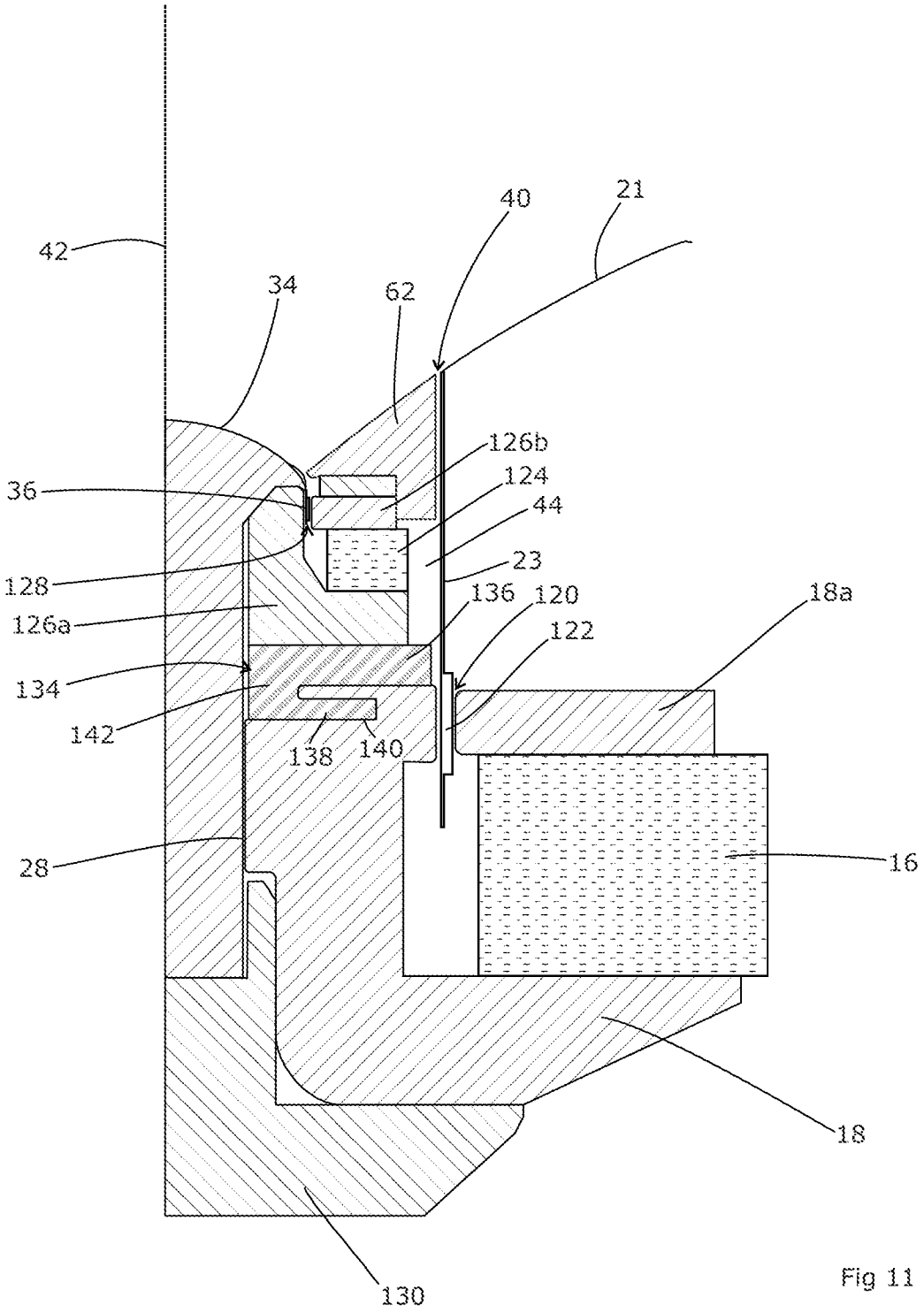
FIG. 11 shows a fourth embodiment of the present invention.

FIGS. 10 and 11 show alternative examples. Again, in both figures, like reference numerals are used to denote like parts. Both figures show greater detail in relation to the magnet structure of the tweeter and midrange units; thus the midrange unit has a magnet 16 with pole pieces 18 and 18*a* conveying the magnetic flux to a gap 120 in which the voice coil 122 for the midrange unit is placed, supported by the voice coil former 23 which extends forward to the midrange diaphragm 21. Likewise, the tweeter has a magnet 124 and pole pieces 126*a*, 126*b* which define a gap 128 in which the voice coil 36 of the tweeter unit sits.

FIGS. 10 and 11 also show the ring nut 130 which attaches to the rear of the tweeter assembly and tightens against the rear of the midrange unit pole piece 18, securing the tweeter unit in place.

In the example of FIG. 10, the sound-absorbent material 132 is in the same general shape as that of FIG. 6, i.e. an annular disc sandwiched between the pole pieces 126*a* and 18 of the tweeter and midrange units respectively, with a cylindrical section extending rearwardly from the inner section of the annulus, located around the tweeter body 28. However, in this example the sound-absorbent material is in a single piece 132 rather than two (or more) sections. It may be formed ab initio in this shape, or cut to shape from a larger block of material. A former such as that illustrated in FIGS. 8 and 9 may be used to support the material, or may be set into the material prior to fitting.

FIG. 11 shows an alternative shape of sound-absorbent material 134. It retains the annular disc section 136, sandwiched between the pole pieces 126*a* and 18 of the tweeter and midrange units respectively. However, instead of a cylindrical section extending rearwardly around the tweeter body 28, there is a second annular disc 138 located behind the first annular disc 136 within a radial slot 140 formed in the midrange pole piece 18. The two discs are joined via a short cylindrical linking section 142. The various elements of the sound-absorbing material 134 are, in this example, in a single contiguous unit, but may of course be made up of several small sub-units assembled together to form the required shape.

Thus, in the example of FIG. 11, the sound path is along the open channel 44, then radially inwardly through the first annular disc 136, then axially through the linking section 142 and, lastly, radially outwardly through the second annular disc 138. Some sound may reflect from the base of the radial slot 140, but it will be reflected back into the sound-absorbent material 134 and is therefore unlikely to escape. This demonstrates that it is the overall path length that is of particular interest, as opposed to the specific shape in which that path is formed.

Thus, the present invention provides a straightforwardly-manufacturable structure that alleviates the problematic resonances caused by the air gap between the two elements of a co-axial loudspeaker. A variety of detailed structures are possible, allowing the solution to be applied to a wide variety of loudspeaker designs, which may differ from those illustrated.

It will of course be understood that many variations may be made to the above-described embodiment without departing from the scope of the present invention.

What is claimed is:

1. A loudspeaker, comprising first and second drivers located substantially coaxially with the first driver located centrally and the second driver located around the first driver, each driver having a voice coil former, the loudspeaker including a spacing between the outermost extent of the first driver and the innermost extent of the second driver thus defining an axially-extending space, the space being bounded at its radially outer side for at least part of its axial extent by the voice coil former of the second driver, the axially-extending space being large enough to have a quarter-wave resonant frequency below the passband of the first driver and containing a sound-absorbent material.

2. The loudspeaker according to claim 1 in which the sound-absorbent material extends axially and has a radially outermost edge which is for at least part of its axial extent, at least one of adjacent to the voice coil former of the second driver or bounded by the voice coil former of the second driver.

3. The loudspeaker according to claim 1 in which the space is bounded at its radially inner side for at least part of its extent by a circumferentially-extending solid housing of the first driver.

4. The loudspeaker according to claim 1 in which the space extends rearwardly beyond the voice coil former of the second driver, in which region the sound-absorbent material completely fills the space.

5. The loudspeaker according to claim 4 in which the sound-absorbent material adjacent the voice coil former of the second driver is contained within the space along one edge thereof leaving an air gap remaining adjacent to the voice coil former.

6. The loudspeaker according claim 5 in which the sound-absorbent material is contained within the space along one edge of the outermost extent of the first driver.

7. The loudspeaker according to claim 1 in which the space is bounded at its radially outer side for at least part of its extent by the magnet structure of the second driver.

8. The loudspeaker according to claim 1 in which the space is annular.

9. The loudspeaker according to claim 1 in which the space is concentric around the first driver.

10. The loudspeaker according to claim 1 in which the space has a radius which varies along its axial extent.

11. The loudspeaker according to claim 10 in which the radius varies in a stepwise manner.

12. The loudspeaker according to claim 10 in which the radius is at a maximum adjacent the diaphragms of the first and second drivers.

13. The loudspeaker according to claim 1 in which the sound-absorbent material is one of an acoustic foam, a fabric, an open-cell foam, and a closed-cell foam.

14. The loudspeaker according to claim 1 in which the sound-absorbent material is supported on a former that is fitted to the first driver.

15. The loudspeaker according to claim 14 in which the former comprises a cylindrical section that fits around the first driver.

16. The loudspeaker according to claim 14 in which the former includes circumferentially-outwardly-projecting fingers for supporting the sound-absorbent material.

17. A loudspeaker comprising first and second drivers, each having a voice coil and a voice coil former, located substantially coaxially with the first driver located within the cavity formed by the voice coil of the second driver, the loudspeaker including a spacing between the outermost extent of the first driver and the innermost extent of the voice coil former of the second driver, the spacing being bounded at its radially outer side for at least part of its axial extent by the voice coil former of the second driver, the axially-extending space being large enough to have a quarter-wave resonant frequency below the passband of the first driver and containing a sound-absorbent material.

* * * * *